United States Patent [19]

Salomon

[11] 4,135,734

[45] Jan. 23, 1979

[54] SKI BINDING

[75] Inventor: Georges P. J. Salomon, Annecy, France

[73] Assignee: Establissements Francois Salomon & Fils, Annecy, France

[21] Appl. No.: 776,752

[22] Filed: Mar. 11, 1977

[30] Foreign Application Priority Data

Mar. 18, 1976 [FR] France ..... 76 07868

[51] Int. Cl.[2] ..... A63C 9/00

[52] U.S. Cl. ..... 280/618; 33/192

[58] Field of Search ..... 280/613, 616, 618; 33/189, 190, 191, 192, 3 B, 3 C

[56] References Cited

U.S. PATENT DOCUMENTS

| | | | |
|---|---|---|---|
| 3,101,201 | 8/1963 | Hall | 280/616 |
| 3,170,702 | 2/1965 | Beier | 280/616 |
| 3,987,553 | 10/1976 | Salomon | 280/616 X |

*Primary Examiner*—Joseph F. Peters, Jr.
*Assistant Examiner*—Gene A. Church
*Attorney, Agent, or Firm*—Pollock, Vande Sande & Priddy

[57] ABSTRACT

Two retaining elements are arranged to slide upon a structure designed to be attached temporarily to a boot. A rotating part, to which are hinged two links, the other ends of which are hinged to the retaining elements, makes it possible to adjust the distance therebetween, by moving them simultaneously towards or away from each other.

14 Claims, 13 Drawing Figures

SKI BINDING

The present invention relates to a device for adjusting the distance between the front and rear retaining elements of a safety binding for skis.

Already known, more particularly from U.S. Pat. No. 3,857,186, is a system for adapting the distance between the front and rear elements of a ski binding to the size of the user's boot. According to this system, the retaining elements move along the longitudinal axis of the ski; they are mechanically connected in such a manner that, when one of the elements is moved in one direction, the other element moves in the opposite direction, and a single operation causes the mechanical link to move the elements simultaneously until they reach the position in which the sole of the boot, of the size in question, is clamped and held to the ski.

As indicated in this patent, known devices of this kind make it possible to alter the relative positions of the binding elements in relation to the ski, thus enabling the skier to change his style and making rented skis safer, regardless of the size of the skier's boot.

Devices such as those described in this patent comprise front and rear holding elements designed to co-operate respectively with the toe and heel of the boot, the retaining elements being adapted to move along the longitudinal axis of the ski in a structure secured, at least temporarily, to the ski, and being connected to each other by a mechanism providing drives in opposite directions and actuated by a single control means.

According to one aspect of the present invention, the drive mechanism consists of at least two systems for transmitting articulated movement, on the one hand to one of the retaining elements and, on the other hand, to a part mounted to rotate about an axis secured to the structure and at right angles to the plane of the ski, the hinges on the rotating part being located on each side of the fixed axis.

According to one particular embodiment, the drive mechanism consists of at least one pair of links, each hinged by one end to a part mounted to rotate about an axis at right angles to the structure, the other end of one of the links being hinged to the front retaining element and that of the other link to the rear retaining element.

If it is desired that the retaining elements be displaced equally, the axis about which the rotating part rotates will be equidistant from the link hinges thereon. If, on the other hand, it is desired that one of the retaining elements be displaced more rapidly than the other, the axis of the rotating part will be located at a greater distance from one link hinge than from the other. This arrangement makes various ratios possible.

According to another embodiment of the invention, the transmission systems consist of a series of deformable parallelograms formed by links hinged one to the other, the rotating part in this case consisting of at least one of the links mounted to rotate about a vertical axis on the structure secured to the ski, while two other links are hinged to the front retaining element, and still two other links to the rear retaining element.

As in the preceding embodiment, the retaining elements may be displaced equally or unequally by varying the position of the vertical axis about which one of the links rotates in relation to the hinges of the end-links on the retaining elements.

It is desirable, according to the invention, for the rotating part to be provided with a holding means allowing it to be rotated; this holding means may be of any appropriate type, for instant a slot in the rotating part allowing for the insertion of a tool, such as a screwdriver.

According to another aspect of the invention, the drive mechanism consists of a cable secured, on the one hand, to the rear retaining element and, on the other hand, itself constituting the front retaining element.

The devices according to the invention also comprise means for locking the retaining elements in position after an adjustment, it being important that, once the relative positions of the retaining elements have been adjusted, the elements can no longer move apart, since this might release the boot unexpectedly or make automatic "step-in" impossible.

According to a preferred embodiment, the locking means is simply a locking screw fitted to one of the retaining elements, the screw being adapted to be tightened to the stationary structure of the ski. The locking means could, of course, co-operate with the rotating part, or parts, of the two first embodiments, thus preventing them from rotating once the adjustment has been made. In this case, the locking means is in the form of a bolt located in the structure secured to the ski and engaging with a corresponding profile in the rotating part, the bolt being retractable for the purpose of releasing the rotating part whenever an adjustment is to be made.

A description will now be given, by way of examples only, of two embodiments of the invention illustrated in the drawings attached hereto, wherein.

Figure 1:
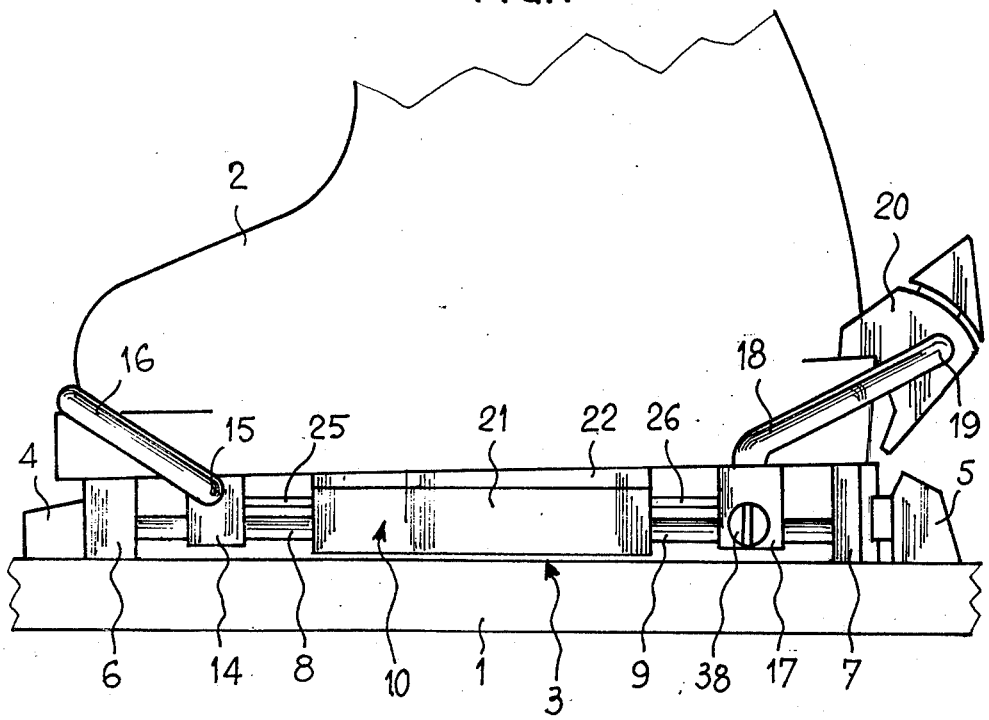
FIG. 1 is a side elevation of a first embodiment of a device according to the invention.
Figure 2:
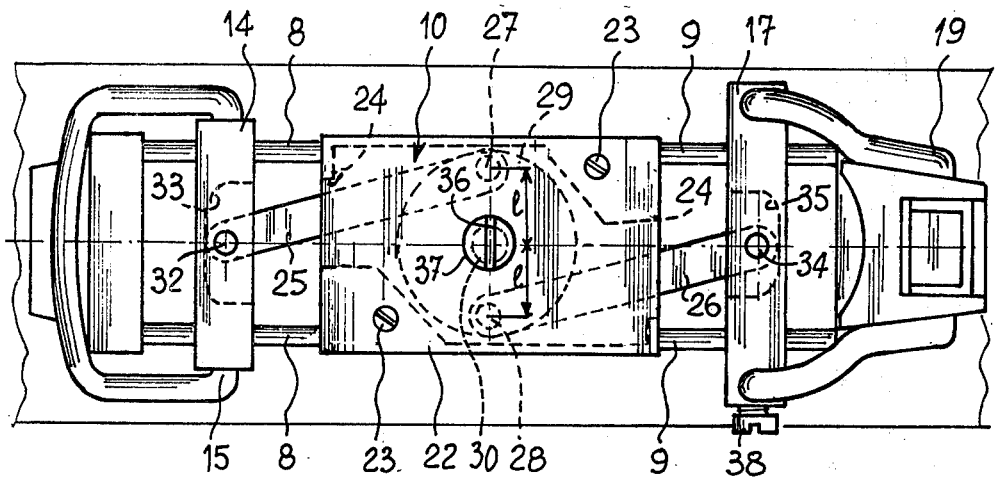
FIG. 2 is a plan view of the device illustrated in FIG. 1, with the boot removed.
Figure 2A:
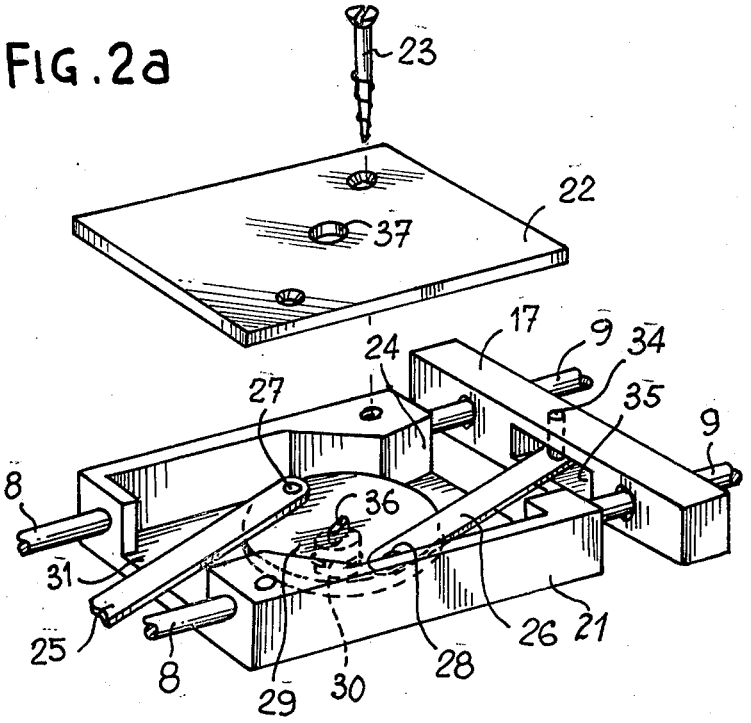
Figure 2C:
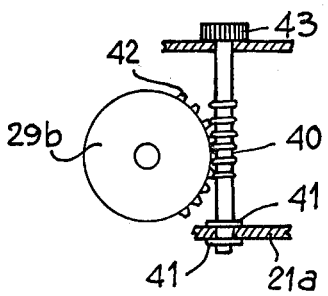
Figure 2B:
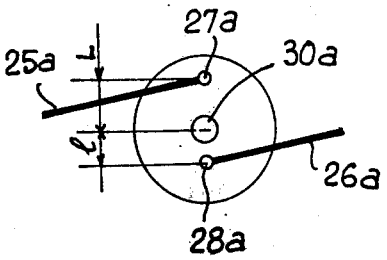
Figure 2D:
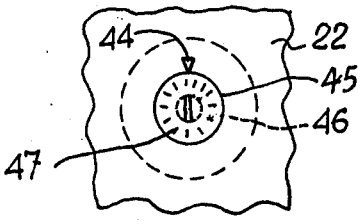
Figure 3:
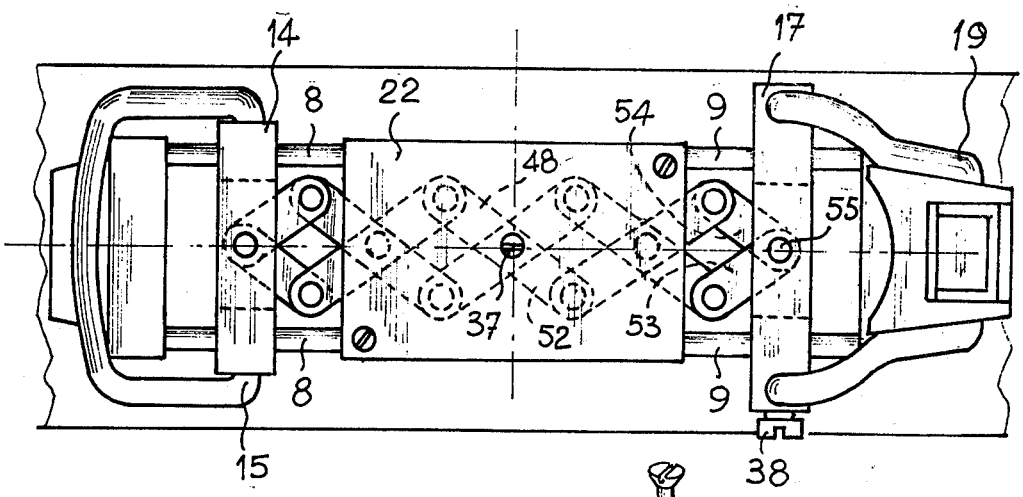
Figure 3A:
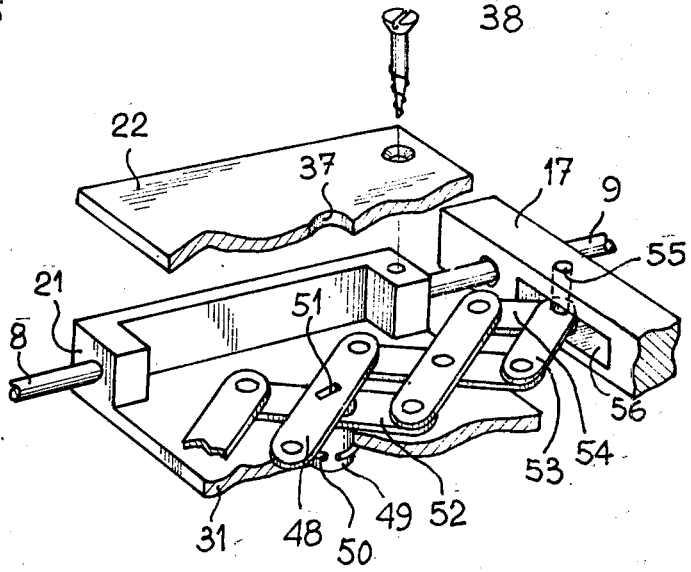
Figure 3B:
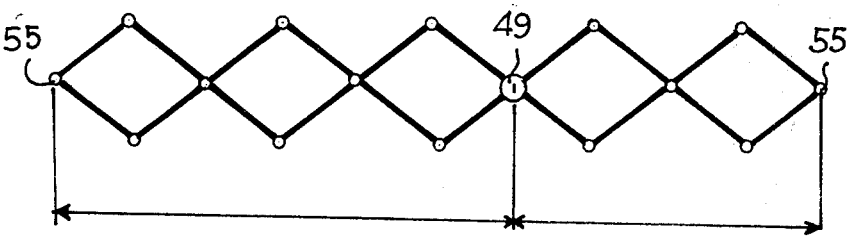
Figure 4:
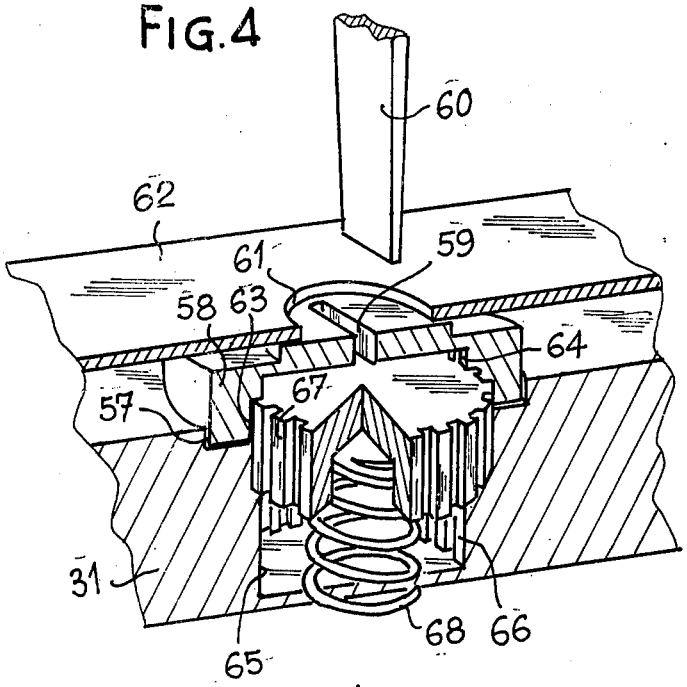
Figure 5:
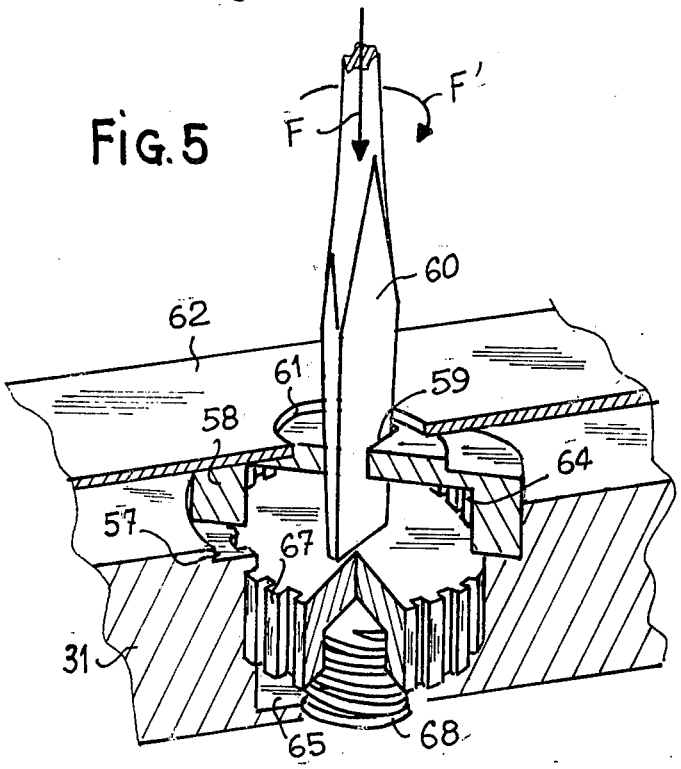
Figure 6:
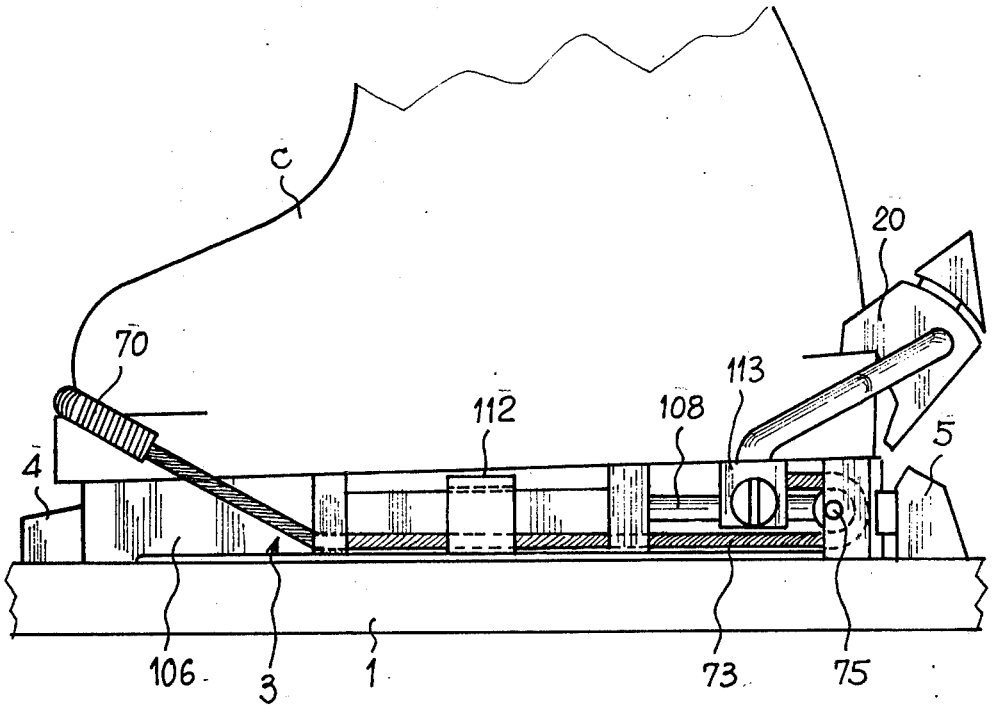
Figure 7:
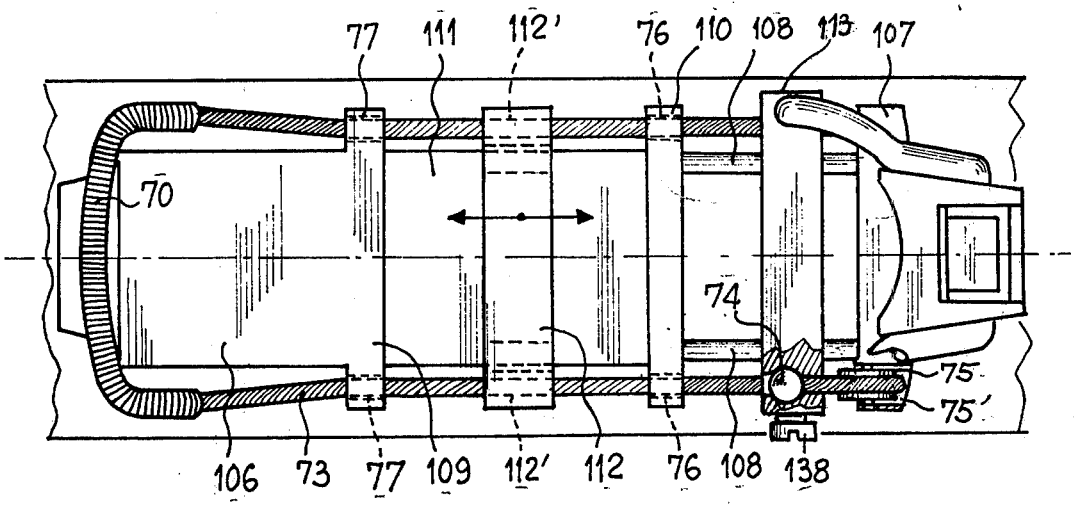

FIG. 2*a* is a perspective view of a detail of the device shown in FIGS. 1 and 2;

FIGS. 2*b*, 2*c*, 2*d* are variants of the detail adapted to the embodiment illustrated in FIGS. 1 and 2;

FIG. 3 is a plan view of a second embodiment according to the invention, with the boot removed;

FIG. 3*a* is a partly broken away perspective view of a detail from FIG. 3;

FIG. 3*b* is a diagrammatic variant of FIG. 3;

FIGS. 4 and 5 illustrate a variant which allows the device to be locked after adjustment;

FIG. 6 is a side elevation of another example of embodiment;

FIG. 7 is a partly broken away plan view of the device according to FIG. 6.

The embodiments dealt with in the following description relate to safety bindings, more particularly to bindings of the type commonly known as plate bindings, in which a plate is fitted and locked temporarily under the sole of the boot, the ends of the plate co-operating with the front and rear bindings secured to the ski, and the safety release occuring between the bindings and plate.

In the embodiments illustrated, the boot is held to the plate by retaining elements which are mounted upon the plate and which co-operate respectively with the toe and heel of the boot.

The invention is, of course, applicable where the boot is held directly to the ski by front and rear retaining elements, in which case the release takes place between the boot and the retaining elements.

Furthermore, the devices according to the invention could also be used for fitting the bindings to the ski, the front and rear retaining elements being replaced by conventional drilling templates.

A description will now be given of a first embodiment, with reference to FIGS. 1 to *2d*, wherein 1 is the ski and 2 is the boot to be held thereto. A plate, generally marked 3, is fixed under the sole of the boot, the front end of this plate being secured to the ski by a front stop 4 of conventional design, and the rear end thereof by a rear binding 5 also of conventional design. The safety release therefore occurs between the plate and the ski, for example in the manner described in U.S. Pat. No. 3,910,591.

Plate 3 consists of a front block 6 designed to cooperate with stop 4 and of a rear block 7 designed to cooperate with binding 5, the blocks being rigidly attached to an intermediate housing 10 by a pair of bars 8, 9.

Mounted slidingly upon front bars 8 is a front crosspiece 14, to which is hinged at 15 an element 16 keeping the toe of the boot in contact with the plate.

In the embodiment illustrated, retaining element 16 is in the form of a stirrup, but it is to be understood that any other type could be used.

Mounted slidingly upon rear bars 9 is a rear crosspiece 17 integral with a yoke 18, upon the cross member 19 of which is mounted pivotably a retaining element 20 designed to co-operate with the heel of the boot in order to keep it in contact with the plate. This rear retaining element may be of any suitable type allowing the boot to be held with a specific force against the plate.

Intermediate housing 10 consists of a substantially parallelepiped-shaped element 21, the top of which is closed off by a cover 22 held in place by screws 23, for example. The front and rear faces of element 21 of the housing have slots 24 through which links 25, 26 respectively project.

In the interior of the housing, links 25, 26 are hinged, at 27, 28, to a rotating part 29 which, in the example illustrated, is in the form of a disc, the rotating part having a vertical axis 30 mounted rotatably upon the bottom 31 of the housing.

Link 25 is also hinged to a vertical axis 32 located in a cavity 33 in front crosspiece 14, whereas link 26 is hinged to a vertical axis 34 located in a cavity 35 in rear crosspiece 17.

It will be noted that the upper surface of rotating part 29 carries a slot 36, which may be reached by a screwdriver, for example, through a hole 37 in cover 22 of the housing.

In the embodiment illustrated in FIGS. 2 and *2a*, vertical axis 30 of the rotating part is located equidistantly from link hinges 27, 28 upon the rotating part.

As will be seen hereinafter, this arrangement assures exactly equal displacement of the front and rear retaining elements of the binding.

Finally, it will be observed that a locking screw 38 is engaged in rear crosspiece 17, the screw co-operating with corresponding bar 9 in such a manner that the crosspiece is locked when the screw is tightened, as is the device as a whole. In order to adapt the distance between retaining elements 20 and 16 to the size of a particular boot, screw 38 is loosened to allow the retaining elements to slide freely along bars 8 and 9.

When the adjustment is made without the boot, the operator merely introduces the tip of a screwdriver into slot 36 in rotating part 29, in order to rotate the part in one direction or the other. When part 29 is rotated, links 25, 26 move crosspiece 14, 17. As soon as the proper setting is reached, this is secured by tightening screw 38.

In order to put the ski on, the skier then engages the toe of his boot under yoke 16 and then lowers the heel of the boot. This causes rear retaining element 20 to pivot into the locking position shown in FIG. 1.

During an adjustment, the structure described in conjunction with FIGS. 1 and 2 assures identical travel of the front and rear retaining elements. However, under certain circumstances it may be necessary, with a single operation, to cause one of the retaining elements to travel farther than the other. This may be achieved very simply by the adaptation illustrated in FIG. *2b*. In this variant, only one part 29*a* is shown rotating about a vertical axis 30*a* and, in this case, one of the hinges, for example hinge 28*a* of link 26*a*, is closer to axis 30*a* than hinge 27*a* of link 25*a*. In the example illustrated, distance "l" between 30*a* and 28*a* is shorter than distance "L" between 30*a* and 27*a*; this provides a step-down ratio in the displacement of one of the retaining elements.

Furthermore, instead of using a screw 38, as in FIGS. 1 and 2, for locking the device after an adjustment has been made, a mechanism such as that shown in FIG. *2c* may be used as a locking means.

This mechanism consists of a worm 40 mounted transversely in the housing so that it can rotate. However, it is prevented from moving axially by any suitable means, more particularly by locking rings 41 fitted to the shank of the worm on each side of wall 21 of the housing. In this case, rotating part 29*b* has at least a toothed sector 42 on its periphery, engaging with the worm. It will be immediately understood that all that is required to make an adjustment is to turn knob 43 of the worm in one direction of the other, for the purpose of causing part 29*b* to rotate.

Moreover, in order to obtain more rapid adjustment, boot sizes may be shown is indicated in FIG. *2d*. In this case, cover 22 of the housing may be provided with a stationary reference mark 44 located at the periphery of an aperture 45 in the cover through which a portion of rotating part 46 can be seen, upon which boot sizes 47 are inscribed. This provides visual adjustment by boot sizes.

It will, of course, be understood that the reference mark may equally well be carried on the rotating part, while the boot sizes are inscribed on the stationary cover.

In the second embodiment illustrated in FIGS. 3 and *3a*, the mechanism driving the front and rear retaining elements is in the form of a series of deformable parallelograms accommodated in a central housing similar to that shown in FIG. 2.

It will be observed that, with the exception of the drive mechanism, the constituent elements of the plate are identical with those in the preceding example of embodiment.

As shown more particularly in FIG. *3a*, one of the center links 48 comprises a rotating axis 49 passing through bottom 41 of element 21 of the housing, the axis being prevented from moving axially by any suitable means, for example by circlips 50 fitted to the axis on each side of bottom 31. The upper surface of link 48 may furthermore be provided with a slot 51 for the tip of a screwdriver used to turn the link.

Axis 49 carries a link 52 which is thus located between link 48 and bottom 31 of the housing, the link being mounted to rotate freely in relation to axis 49.

Hinged to the ends of links 48 and 52, about vertical axes, are other links constituting deformable parallelograms. Terminal links 53, 54 are hinged to a vertical axis 55 located in a cavity 56 in front crosspiece 14 or rear crosspiece 17.

In this embodiment, the binding is adjusted to the size of the boot by means of link 48 which allows retaining elements 16 and 20 to be moved towards or away from each other.

The device may be locked in place after an adjustment by tightening screw 38 in rear crosspiece 17, as in the preceding embodiment.

In the embodiment illustrated in FIGS. 3 and 3*a*, axis 49 is equidistant from hinges 55 on crosspieces 14 and 17. Any adjustment will therefore causes the front and rear retaining elements to travel over the same distance, since the device is perfectly symmetrical.

However, dissimilar displacements may easily be obtained by means of a system of deformable parallelograms which is asymmetrical in relation to axis 49, as shown diagrammatically in FIG. 3*b*.

In this figure it will be seen that there are two parallelograms between axis 49 and hinge 55 on rear crosspiece 17, whereas there are three such parallelograms between axis 49 and hinge 55 on front crosspiece 14. The front crosspiece will therefore move faster than the rear crosspiece.

A description will now be given, with reference to FIGS. 4 and 5, of a possible variant of the locking and operation of the drive mechanism, which could be adapted to one or other of the embodiments described above, and which eliminates locking screw 38. Thus FIGS. 4 and 5 illustrate means for unlocking, adjusting, and relocking the drive mechanism.

To this end, the bottom of the housing accommodating the drive mechanism comprises a dish 57 accommodating a rotating part 58 which either constitutes a part of the center link of the second embodiment, or is designed to receive the links of the first embodiment.

Rotating part 58 has a slot 59 which fits the end 60 of a screwdriver introduced through an aperture 61 in cover 62 of the housing. Located in the lower portion of part 58 is a cavity 63, the periphery of which carries grooves 64.

Dish 57 is extended by a blind hole 65, the periphery of which also carries grooves 66 and in which is located a toothed wheel 67 which engages with grooves 66 in the blind hole. Located between the bottom of the blind hole and the toothed wheel is a spring 68 urging the toothed wheel in an upward direction, in such a manner that the teeth thereof (see FIG. 4) engage in grooves 64 in rotating part 58. It will be noted that toothed wheel 67 if free to slide vertically upon its axis in blind hole 65.

In the normal position illustrated in FIG. 4, spring 68 urges toothed wheel 67 into the locking position of rotating part 58 and, since the teeth of wheel 67 bridge the gap between teeth 66 of the blind hole and teeth 64 of the toothed wheel, the latter is prevented from rotating. The drive mechanism is therefore locked in place.

As shown in FIG. 5, when it is desired to make an adjustment, a screwdriver is engaged in slot 59 in rotating part 58, vertical pressure being applied to the screwdriver in the direction of arrow F for the purpose of moving toothed wheel 67, against the action of spring 68, down into the position shown in FIG. 5.

In this position, teeth 64 of the rotating part are disengaged from the toothed wheel. At this time, the desired adjustment may be made merely by turning the screwdriver in the direction of arrow F′ (or in the opposite direction). As soon as the screwdriver is removed, toothed wheel 67 snaps up and the teeth thereof engage with the teeth of rotating part 58, which is thus locked again.

Finally, and in conjunction with FIGS. 6 and 7, a description will now be given of another embodiment of the invention, in which the drive mechanism is in the form of a cable.

As in the preceding embodiments, a plate is secured temporarily under a boot C, the plate co-operating with front and rear safety bindings, 4, 5.

The plate consists of a front block 106 and a rear block 107 connected rigidly together by a pair of rods 108. The front block has two laterally projecting bars 109, 110, between which is located a section 111 of reduced thickness supporting a slide 112 adapted to move between bars 109, 110.

A rear crosspiece 113 is arranged to slide on rods 108, the crosspiece carrying, as in the preceding embodiments, a rear retaining element 20 designed to co-operate with the heel of the boot.

The ends of crosspiece 113 are drilled to accommodate end 74 of a cable 73. Each section of the cable, on each side of plate 3, runs over a pulley 75 mounted to rotate in a housing 75′ in rear block 107 (in the embodiment illustrated, only one of these pulleys is shown in the broken away portion of FIG. 7); each section of the cable then passes freely through holes 76,77 in bars 109, 110 respectively, the sections meeting in a loop 70, which may be provided with a sheath and which is designed to co-operate with the toe of the boot (see FIG. 6), thus acting as the front retaining element. It will be noted that the cable is secured to slide 112, for example by clamping at 112′ in the holes in each end of the slide.

The distance between front and rear retaining elements 70 and 20 is adjusted by sliding part 112 as shown by the double arrow.

The device may be locked in position by tightening screw 138 in crosspiece 113 against rod 108.

What is claimed is:

1. A device for adjusting the distance between front and rear retaining elements cooperating with the toe and heel of ski boot, said retaining elements being movably mounted in a structure fixed at least temporarily to a ski and being connected to one another by a drive mechanism for moving said retaining elements in opposite directions along the longitudinal axis of said ski, comprising (a) a single control means for actuating said drive mechanism;

(b) said drive mechanism comprising at least two systems for transmitting movement;

(c) a member mounted for rotation about a fixed axis secured to said structure and at right angles to the plane of said ski;

(d) hinge means on said rotatable member respectively located on opposite sides of said fixed axis;

(e) said two transmission systems being articulated to one of said retaining elements and to said rotatable member, respectively.

2. A device according to claim 1, wherein each transmission system comprises at least one link extending approximately parallel with the plane of the ski and connected by hinges to said rotatable member.

3. A device according to claim 1, wherein the axis about which said rotatable member pivots is equidistant from said hinges of said links thereon, so that when said part is rotated, the distances travelled by said two retaining elements are equal.

4. A device according to claim 1, wherein the axis of about which said rotating part pivots is farther away from one of said hinges thereon than from the other, so that when said part is rotated, the distances travelled by said two retaining elements are unequal.

5. A device according to claim 1, wherein said transmission systems comprise a plurality of deformable parallelograms consisting of links connected to each other by hinges, said rotatable member comprising at least one of said links rotating about an axis at right angles to said structure secured to said ski, whereas two other links are hinged, respectively, to said front retaining element and said rear retaining element.

6. A device according to claim 5, wherein said vertical axis of said structure about which one of said links rotates is located half-way between the terminal link hinges on said retaining elements, for the purpose of obtaining symmetrical movement of said retaining elements.

7. A device according to claim 5, wherein the distances between said vertical axis of said structure and said terminal link hinges on said retaining elements are unequal, so that the distances travelled by said retaining elements are unequal.

8. A device according to claim 1, including a gripping means on said rotation part allowing the latter to be rotated,

9. A device according to claim 1, including means to lock the retaining elements in place after an adjustment.

10. A device according to claim 1, wherein said locking means comprises a screw fitted to one of said retaining elements, and means for tightening said screw against said structure secured to said ski.

11. A device according to claim 1, comprising a locking means co-operating with said rotating member to prevent said member from turning.

12. A device according to claim 11, wherein said locking means comprises a bolt movably housed in said structure secured to said ski, said bolt being normally in engagement with a matching profile in said rotating member, and being retractable for the purpose of releasing said rotating member.

13. A device according to claim 12, said locking means comprising a toothed wheel secured against rotation in a housing in said structure, but capable of movement at right angles to said rotating member, said rotating member itself having a toothed housing, and said toothed wheel being spring-loaded to project into the interior of said toothed housing of said rotating member, in order to prevent the latter from rotating.

14. A device according to claim 13, including a slot in said rotating member for the introduction of a tool, for the purpose of retracting said toothed wheel and releasing said rotating member which may then be actuated.

* * * * *